US006364379B1

(12) United States Patent
Roberts et al.

(10) Patent No.: US 6,364,379 B1
(45) Date of Patent: Apr. 2, 2002

(54) VEHICLE COMPARTMENT LATCH

(75) Inventors: Richard A. Roberts, Thompsons Station; Mark E. Campbell, Franklin; Jack C. Wilmore, Mt Juliet, all of TN (US); Lindley T. Berry, Southfield, MI (US); Dikran Ghorghorian, Scarborough; Sorin S. Tudora, Newmarket, both of (CA)

(73) Assignees: General Motors Corporation, Detroit, MI (US); Magna International, Inc., Aurora (CA)

( * ) Notice: Subject to any disclaimer, the term of this patent is extended or adjusted under 35 U.S.C. 154(b) by 0 days.

(21) Appl. No.: 09/453,044

(22) Filed: Dec. 2, 1999

(51) Int. Cl.[7] ..... E05C 3/06

(52) U.S. Cl. ..... 292/216; 292/DIG. 43; 292/DIG. 65

(58) Field of Search ..... 292/216, DIG. 43, 292/DIG. 65

(56) References Cited

U.S. PATENT DOCUMENTS

| | | | | | |
|---|---|---|---|---|---|
| 5,074,603 | A | * | 12/1991 | Brackmann | 292/216 |
| 5,277,461 | A | * | 1/1994 | Dzurko | 292/216 |
| 5,906,123 | A | * | 5/1999 | Spurr | 70/264 |
| 6,193,301 | B1 | * | 2/2001 | Baumeier | 296/121 |

* cited by examiner

*Primary Examiner*—Gary Estremsky
(74) *Attorney, Agent, or Firm*—Laura C. Hargitt

(57) ABSTRACT

A vehicle closure has a compartment latch that includes a safety device that is automatically engaged to disable the compartment latch when the compartment latch is unlatched. The safety device must be reset manually to restore normal operation of the compartment latch. Manual resetting requires repeated manipulation of a pawl lever to avoid inadvertent disengagement of the safety device, particularly by children.

7 Claims, 4 Drawing Sheets

VEHICLE COMPARTMENT LATCH

TECHNICAL FIELD

This invention relates to a vehicle compartment latch and more particularly to a vehicle compartment latch for latching a vehicle compartment closure, such as a trunk deck lid in the closed position to secure the vehicle compartment.

BACKGROUND OF THE INVENTION

Passenger vehicles are normally equipped with a rear vehicle compartment for storing a spare tire and transporting items such as groceries and luggage. The compartment, conventionally known as a trunk is closed by a deck lid that is hinged to the vehicle body and swings open to provide access to the compartment. The closure or deck lid is equipped with a compartment latch that cooperates with a striker attached to the vehicle body to latch the closure in the closed position automatically when the deck lid is closed.

In order to open the deck lid, the compartment latch is usually designed to be unlatched or opened from a position outside the compartment because the compartment is not designed to hold passengers. This compartment latch characteristic results in a possibility of a child (or older person) being trapped inside the trunk without any way for the trapped child to unlatch and open the deck lid.

SUMMARY OF THE INVENTION

The object of the invention is to provide a vehicle compartment latch that does not automatically latch when deck lid is closed against the striker.

A feature of the invention is that the vehicle compartment latch is equipped with a safety device that disables the detent lever when the compartment latch is unlatched thus preventing an inadvertent automatic latching of the vehicle compartment latch when the deck lid is closed subsequently.

Another feature of the invention is that the vehicle compartment latch is equipped with a safety device that must be reset manually after the compartment latch is unlatched in order to arm the compartment latch for a subsequent latching operation.

Another feature of the invention is that the vehicle compartment latch is equipped with a safety device that is automatically engaged but difficult to reset.

Still another feature of the invention is that the vehicle compartment latch is equipped with a safety device that disables the latch detent in response to an unlatching operation.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
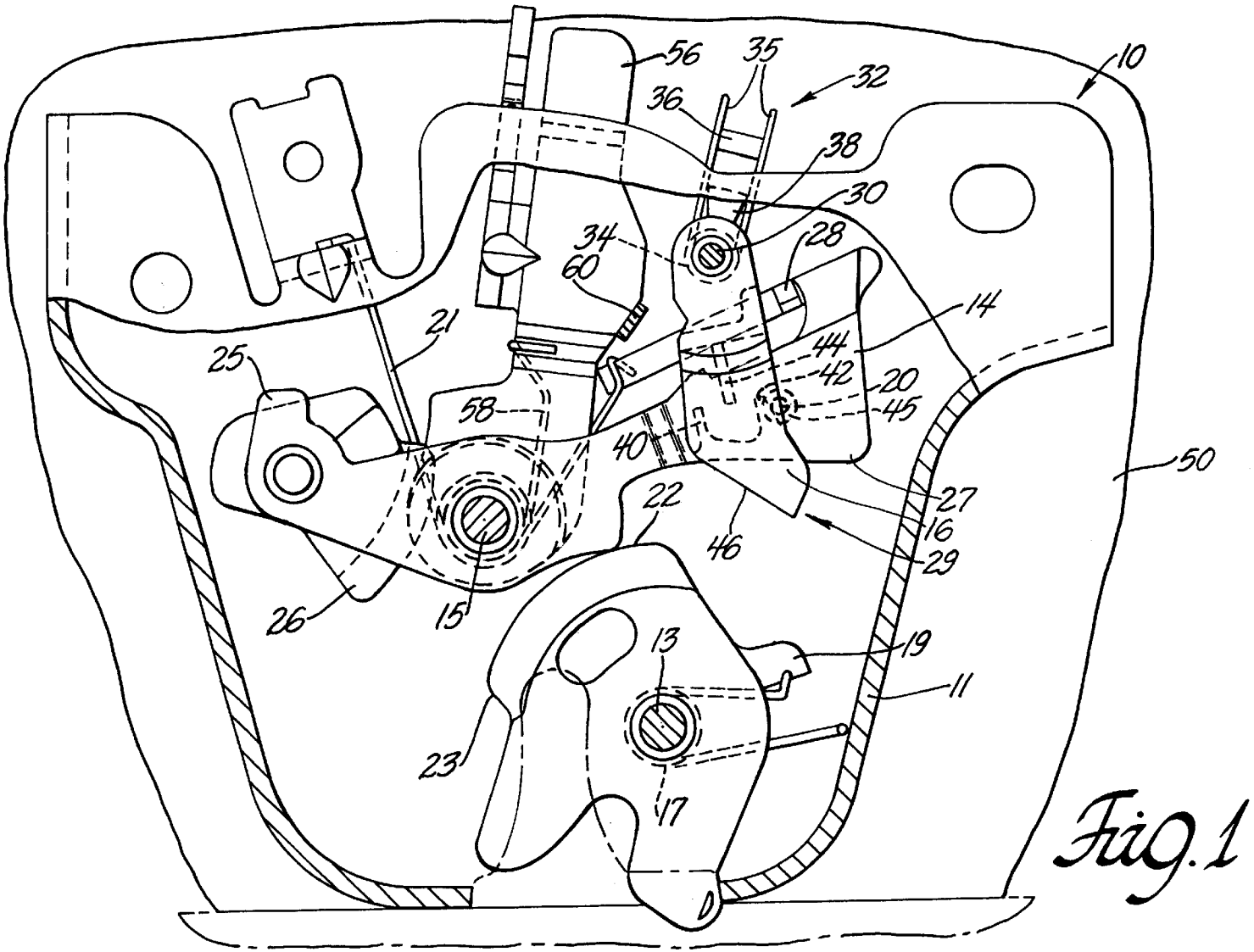
FIG. 1 is a fragmentary rear view of a vehicle compartment latch of the invention showing internal parts of the vehicle compartment latch in the open or unlatched position and armed (i.e. with the safety device reset)

Vehicle compartment latch 10 comprises a housing or support 11 that is adapted for fastening to a vehicle compartment closure, such as a trunk compartment deck lid 50 and a fork bolt 12. Fork bolt 12 pivots on support 11 about pivot pin 13 between an open or unlatched position shown in FIG. 1 and a closed or latched position shown in FIG. 2. Vehicle compartment latch 10 is attached to the deck lid 50 so that fork bolt 12 is moved from the open position shown in FIG. 1 to the closed position shown in FIG. 2 when deck lid 50 is closed and fork bolt 12 engages a striker 52 that is attached to the vehicle body 54 at the deck lid opening. The cooperation of a fork bolt and striker is well known and need not be described in detail.

Figure 2:
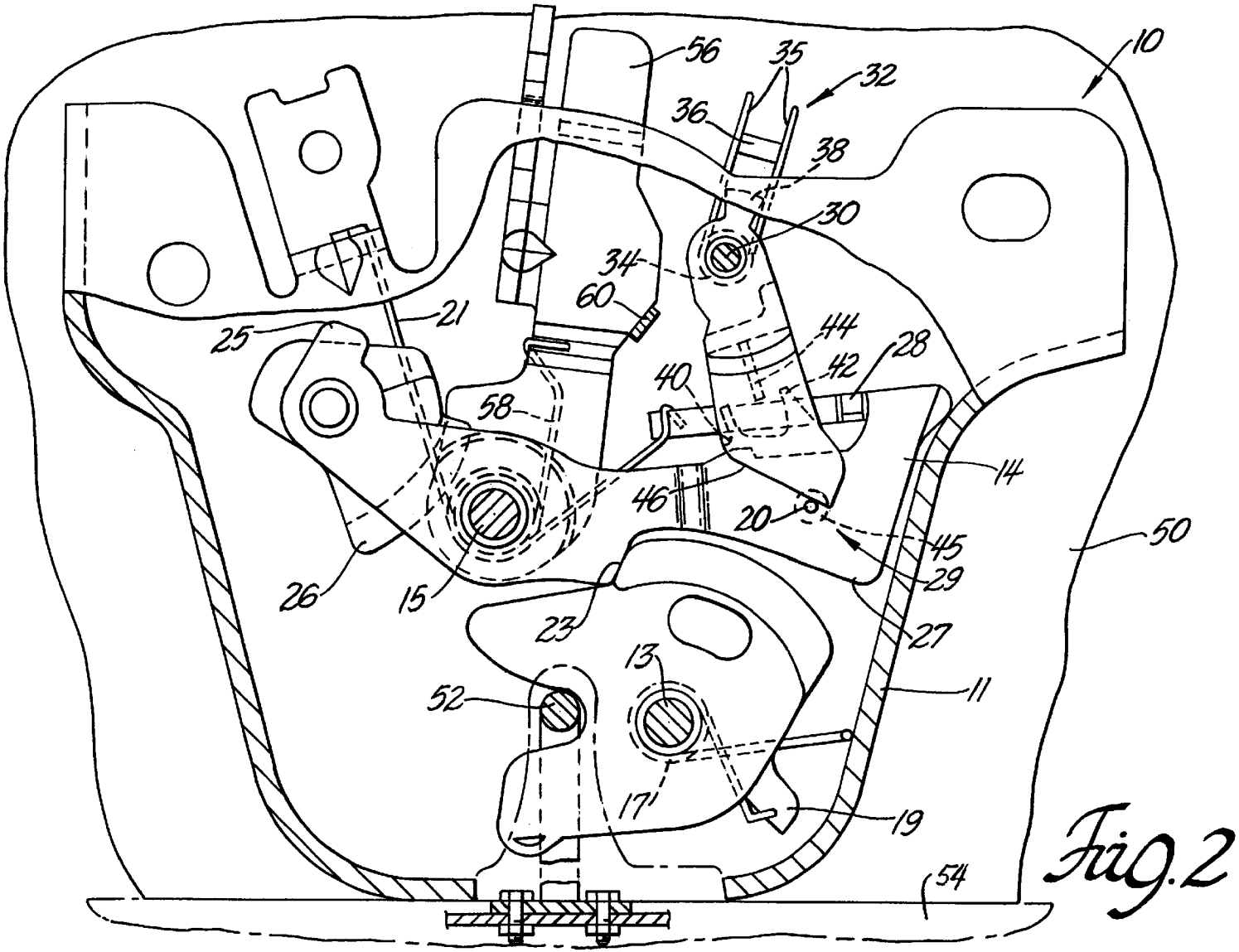
FIG. 2 is a fragmentary rear view of the vehicle compartment latch of FIG. 1 showing the internal parts of the vehicle compartment latch in the latched position.

Vehicle compartment latch 10 further comprises a pawl lever 14 that pivots on support 11 about pivot pin 15 and cooperates with fork bolt 12 in a well known manner to retain fork bolt 12 in the closed position shown in FIG. 2 or release the fork bolt 12 for return to the open position shown in FIG. 1. That is, pawl lever 14 pivots between a detent position shown in FIG. 2 and a release position shown in FIG. 1. Pawl lever 14 also pivots to two successive disarmed positions as explained below.

Fork bolt 12 is spring biased counterclockwise to the open position shown in FIG. 1 by a coil spring 17 that surrounds pivot pin 13 with an extension at one end engaging ear 19 of fork bolt 12. An extension at the other end of coil spring 17 engages an abutment of support 11. Pawl lever 14 is spring biased clockwise by a second coil spring 21 that surrounds pivot pin 15 with an extension at one end engaging pawl lever 14 and an extension at the other end engaging another abutment of support 11. Coil spring 21 biases pawl lever 14 clockwise to the detent position shown in FIG. 2 where pawl lever 14 engages a release lever 56. Release lever 56 is pivotally mounted on pivot pin 15 behind pawl lever 14 and is spring biased by a third coil spring 58 counterclockwise against a stop 60 of support 11. Thus pawl lever 14 rides on portion 22 of fork bolt 12 and then pivots clockwise with respect to release lever 56 to engage latch shoulder 23 of fork bolt 12 when fork bolt 12 is moved to the closed position by the closing deck lid 50.

Pawl lever 14 has an arm 25 at one end that has a plastic end cap 26 secured to it. End cap 26 engages release lever 56 when pawl lever 14 is in the detent position shown in FIG. 2. Pawl lever 14 is moved from the detent position shown in FIG. 2 to a release position shown in FIG. 1 by pivoting release lever 56 counterclockwise so that pawl lever 14 is pivoted counterclockwise to the release position. Release lever 56 is pivoted by a pull cable that is attached to an upper end of release lever 56 and that is operated by a conventional key lock cylinder (not shown) to move pawl lever 14 o the release position allowing the deck lid 50 to open. Alternatively release lever 56 can be pivoted by an electrically driven cam lever (not shown) that is remotely controlled.

Pawl lever 14 has a second arm 27 at the opposite end that is equipped with a stop pin 20 and a cable attachment 28.

Stop pin 20 and cable attachment 28 are part of a safety device 29 that disarms or disables vehicle compartment latch 10. Safety device 29 further comprises a rotary cam 16 that is attached to support 11 by a pivot pin 30. Cam 16 is spring biased to the armed position shown in FIG. 1 by a spring centering arrangement indicated generally at 32. This arrangement comprises a coil spring 34 that surrounds pivot pin 30 with radial end extensions 35 that engage opposite sides of a stop tab 36 of support 11. Cam 16 has a projection 38 on one end portion that fits between the two radial end extensions 35 so that cam 16 is always spring biased to the armed position of FIG. 1 whether cam 16 is pivoted from this position in the clockwise direction or in the counterclockwise direction.

Cam 16 has circumferentially spaced abutments 40 and 42, an upper guard rib 44 and a cam surface 46 on the opposite end portion that cooperate with stop pin 20 to prevent inadvertent latching of vehicle closure latch 10.

Vehicle compartment latch 10 operates in the following manner. When the deck lid 50 is closed, striker 52 engages fork bolt 12 pivoting fork bolt 12 clockwise from the open or unlatched position shown in FIG. 1 to the closed or latched position and trapping striker 52 in the compartment latch 10 as shown in FIG. 2. As fork bolt 12 pivots to the closed position of FIG. 2, pawl lever 14 being spring biased clockwise, rides on portion 22 of fork bolt 12 and then pivots clockwise to engage latch shoulder 23 as shown in FIG. 2.

As pawl lever 14 pivots clockwise, stop pin 20 pivots rotary cam 16 clockwise slightly via cam surface 45 and moves to a position engaging cam surface 46 on the bottom of cam 16 as shown in FIG. 2. Deck lid 50 is now latched closed securely by vehicle compartment latch 10 which is now cocked for automatic actuation of safety device 29 when fork bolt 12 of vehicle compartment latch 10 is released and deck lid 10 is opened.

Figure 3:
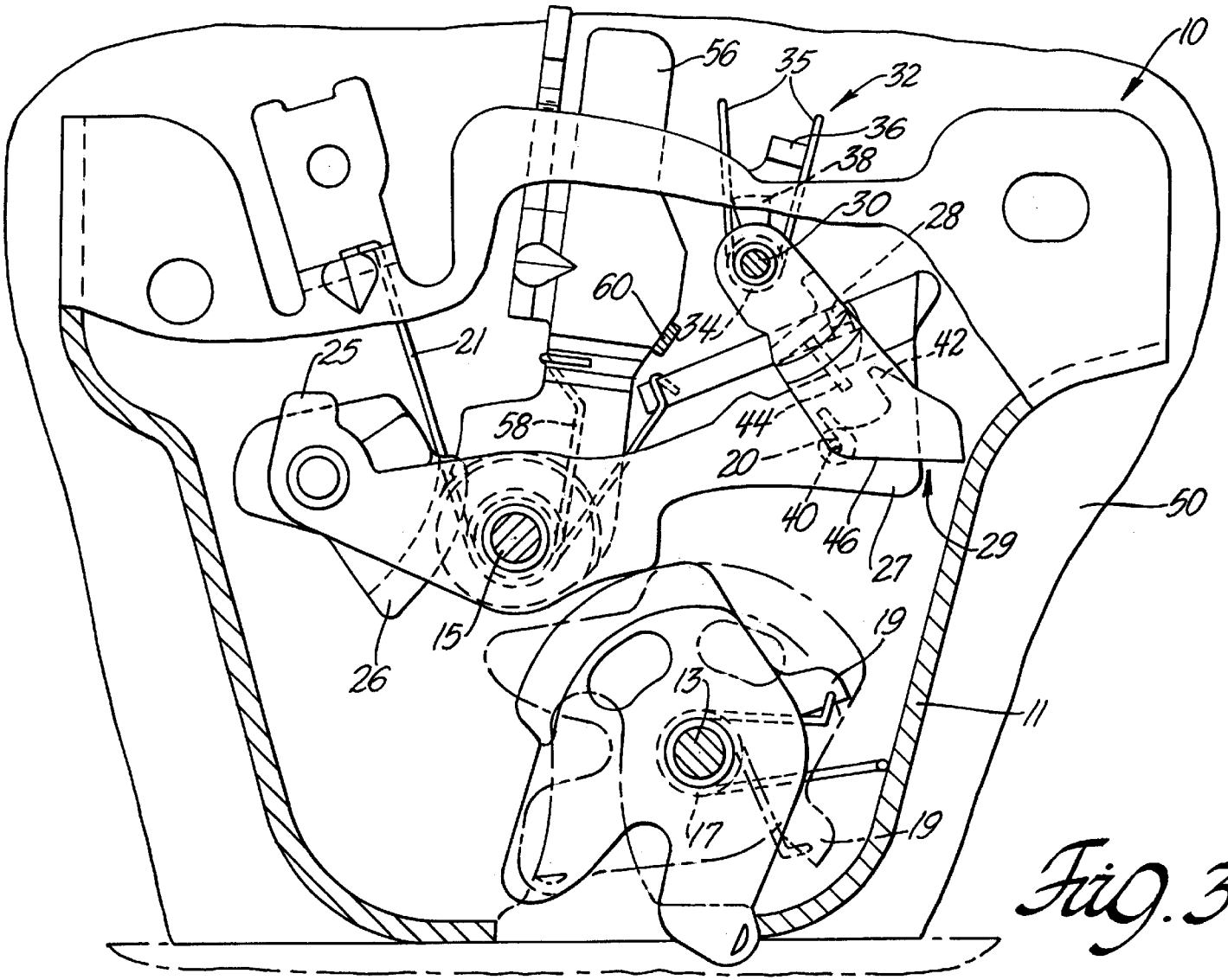
FIG. 3 is a fragmentary rear view of the vehicle compartment latch shown of FIG. 1 showing the internal parts of the vehicle compartment latch in the open or unlatched position and disarmed (i.e. with the safety device engaged)

Fork bolt 12 is released by pivoting release lever 56 counterclockwise which pivots pawl lever 14 counterclockwise raising arm 27 away from latch shoulder 23. As pawl lever 14 pivots counterclockwise, stop pin 20 pivots rotary cam 16 counterclockwise until stop pin 20 engages the first abutment 40 of cam 16 as shown in FIG. 3. For such engagement cam 16 returns clockwise a small distance under the bias of coil spring 34. Vehicle compartment latch 10 is now disarmed or disabled and cannot be latched. When deck lid 50 is subsequently closed, fork bolt 12 pivots to the latched position as shown in dashed line in FIG. 3. However pawl lever 14 does not engage latch shoulder 23 and hence striker 52 can be withdrawn freely. Thus whenever deck lid 50 is closed with safety device 29 engaged, the deck lid 50 can be reopened from the interior of the trunk or other closure simply by lifting the deck lid.

In order to latch the deck lid 50 in the closed position, safety device 29 must be disengaged or reset before the deck lid 50 is closed. Safety device 29 is disengaged or reset in two stages by moving pawl lever 14 counterclockwise against the bias of coil spring 21 twice. This can be done by lifting cable attachment 28 up twice which returns cam 16 to the disengaged or reset position shown in FIG. 1. In response to the double lift, cam 16 is pivoted clockwise with respect to support 11 from the engaged position shown in FIG. 3 to the interim, partially reset position shown in FIG. 4 to the reset position shown in FIG. 1 under the bias of spring 34.

Figure 4:
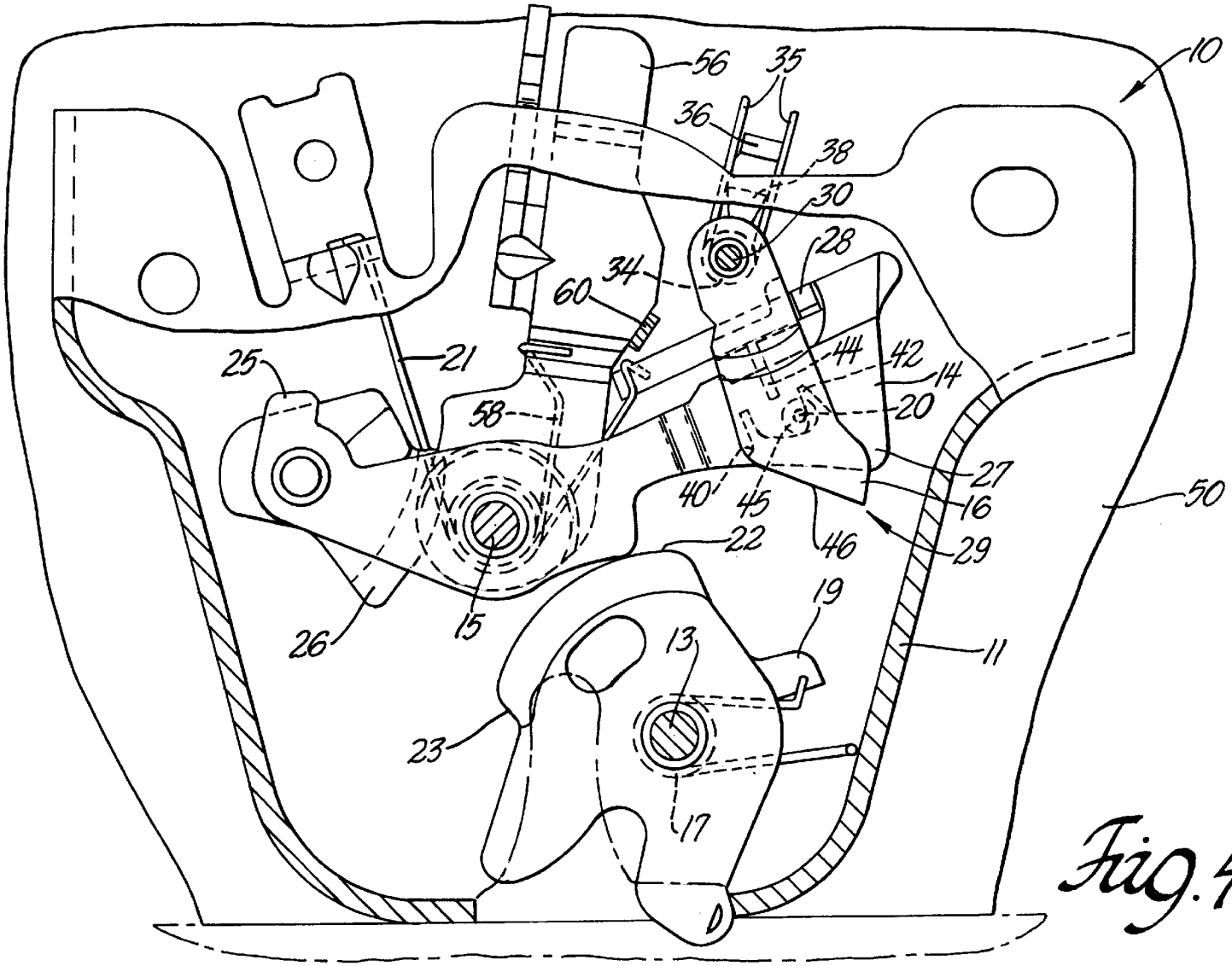
FIG. 4 is fragmentary rear view of the vehicle compartment latch of FIG. 1 showing the internal parts of the vehicle compartment latch in the open or unlatched position and partially rearmed (i.e. with the safety device partially reset in response to a first disengagement manipulation).

To move cam 16 clockwise to the interim partially reset position of FIG. 4, cable attachment 28 is lifted until stop pin 20 clears the first abutment 40 whereupon cam 16 pivots clockwise under the bias of spring 34 until stop pin 20 engages abutment 42 as shown in FIG. 4. Cam 16 preferably includes guard rib 44 to prevent stop pin 20 being lifted long enough to overshoot the second abutment 42.

Cam 16 is then fully reset by lifting cable attachment 28 a second time so that stop pin 20 clears the second abutment 42 whereupon cam 16 pivots clockwise to the fully reset position shown in FIG. 1 where stop pin 20 engages cam surface 45 of cam 16. Vehicle closure latch 20 is now fully reset for latching engagement with striker 52 when deck lid 50 is subsequently closed.

It should be noted that the disengagement or resetting operation of safety device 29 requires two distinct manipulations of the pawl lever 14. The resetting operation is purposely made difficult in order to further avoid inadvertent resetting of the safety device 29 particularly by a child who must be able to Figure out the requirement for the repeated manipulation of pawl lever 14.

While the compartment latch of our invention has been described in connection with deck lid 50, the compartment latch 10 can be used with other compartment closures where unintentional latching is not desirable. Moreover, the pawl lever 14 can be manipulated by a pull cable or other suitable device rather than lifted directly. In other words, many modifications and variations of the present invention in light of the above teachings may be made. It is, therefore, to be understood that, within the scope of the appended claims, the invention may be practiced otherwise than as specifically described.

What is claimed is:

1. A vehicle compartment latch comprising:

a support that is adapted for fastening to a closure;

a fork bolt that moves between an open position and a closed position;

a pawl lever that moves between a detent position and a release position, the detent lever retaining the fork bolt in the closed position when in the detent position and releasing the fork bolt for return to the open position when in the release position; and a safety device including a rotary cam that moves between an engaged position and a reset position and to an interim, partially reset position between the engaged position and the reset position, the safety device holding the pawl lever in the release position when the rotary cam is in the engaged position and in the partially reset position and allowing the pawl lever to return to the detent position when in the reset position.

2. The vehicle compartment latch as defined in claim 1 wherein the release lever has a stop pin that engages a first abutment of the rotary cam to hold the cam in the engaged position and a second abutment to hold the cam in the interim, partially reset position.

3. The vehicle compartment latch as defined in claim 2 wherein the cam has a guard rib between the first abutment and the second abutment to insure that the stop pin engages the second abutment.

4. The vehicle compartment latch as defined in claim 2 wherein the stop pin engages a cam surface of the cam when the pawl lever is in the detent position so as to move the cam to the engaged position when the pawl lever is moved to the release position.

5. The vehicle compartment latch as defined in claim 3 wherein the stop pin engages a cam surface of the cam when the pawl lever is in the detent position so as to move the cam to the engaged position when the pawl lever is moved to the release position.

6. A vehicle compartment latch comprising:

a support that is adapted for fastening to a closure;

a fork bolt that moves between an open position and a closed position;

a pawl lever that moves between a detent position and a release position, the detent lever retaining the fork bolt in the closed position when in the detent position and releasing the fork bolt for return to the open position when in the release position; and a safety device including a rotary cam that moves between an engaged position and a reset position, the safety device holding the pawl lever in the release position when the rotary cam is in the engaged position and allowing the pawl lever to return to the detent position when in the reset position;

wherein the release lever has a stop pin that engages an abutment of the rotary cam to hold the cam in the engaged position.

7. The vehicle compartment latch as defined in claim 6 wherein the stop pin engages a cam surface of the cam when the pawl lever is in the detent position so as to move the cam to the engaged position when the pawl lever is moved to the release position.

* * * * *